United States Patent [19]

Coburn

[11] Patent Number: 5,020,436

[45] Date of Patent: Jun. 4, 1991

[54] BOOSTER RETARDING APPARATUS

[75] Inventor: Robert W. Coburn, Apple Valley, Calif.

[73] Assignee: General Dynamics Corp., Air Defense Systems Div., Pomona, Calif.

[21] Appl. No.: 383,484

[22] Filed: Jul. 24, 1989

[51] Int. Cl.[5] ..... F42B 15/10

[52] U.S. Cl. ..... 102/377; 244/3.3

[58] Field of Search ..... 102/293, 377; 244/3.3

[56] References Cited

U.S. PATENT DOCUMENTS

| | | | |
|---|---|---|---|
| 2,936,710 | 1/1956 | Bollay . | |
| 3,004,489 | 1/1958 | Griffith et al. . | |
| 3,047,259 | 7/1962 | Tatnall et al. . | |
| 3,067,971 | 12/1962 | Dew | 244/113 |
| 3,111,900 | 3/1961 | Fitton et al. . | |
| 3,118,636 | 1/1964 | Kantrowitz et al. . | |
| 3,158,336 | 11/1964 | Warren et al. . | |
| 3,167,016 | 1/1965 | Czerwinski et al. . | |
| 3,188,958 | 6/1965 | Burke et al. . | |
| 3,224,370 | 12/1965 | Vogt . | |
| 3,228,634 | 1/1966 | Chakoian et al. | 244/113 |
| 3,329,089 | 7/1967 | Harrison . | |
| 4,693,434 | 9/1987 | Schwenzer et al. | 244/328 |
| 4,856,432 | 8/1989 | Synofzik . | |

*Primary Examiner*—Charles T. Jordan
*Assistant Examiner*—Richard W. Wendtland
*Attorney, Agent, or Firm*—Neil F. Martin; Leo R. Carroll

[57] ABSTRACT

A booster retarding apparatus for an airborne vehicle such as a missile having a separable booster at its rear end, comprises a series of flaps with hinge assemblies for securing the flaps to the aft end of the booster for movement between an inner position extending rearwardly from the booster and an extended position projecting outwardly from the booster. The flaps are biased towards the extended position, and normally retained in the inner position by retaining devices. The retaining devices are released on booster thrust termination, and include a release mechanism responsive to booster thrust termination for releasing the retaining devices. The release mechanism includes a biasing device having a biasing force less than the acceleration forces developed on launch which oppose operation of the release mechanism so that the flaps are held in during booster thrust and are released and urged outwardly on booster thrust termination to brake the booster and separate it from the remainder of the missile.

16 Claims, 2 Drawing Sheets

BOOSTER RETARDING APPARATUS

BACKGROUND OF THE INVENTION

The present invention relates generally to tactical missiles or other rocket vehicles, and is particularly directed to a retarding device for slowing down and separating a booster stage from a final missile or rocket stage in a multi-stage vehicle.

In a boosted tactical missile or other vehicle employing a first stage booster, rapid separation of the booster is required to allow ignition of the upper stage, or final missile stage. Previously, the separation was provided by aerodynamic drag on the forward surfaces on boosters of larger diameter than the remainder of the vehicle. However, boosters of larger diameter than the remainder of the missile take up excess space in the launcher, limiting the number of missiles which can fit into the available launcher volume. In order to place the maximum number of missiles in the available launcher volume, so-called slimline boosters have been developed which are of similar diameter to that of the final missile stage. Little drag is developed by such boosters, since there is little or no increase in diameter from missile to booster. A pyrotechnic device at the missile-booster interface could be used to provide positive booster separation, but this will consume booster volume which could better be used for motor propellant. Also, many slimline boosters are inherently unstable at separation as aerodynamic surfaces will not fit in the limited launcher volume available in maximum missile density applications.

SUMMARY OF THE INVENTION

It is an object of this invention to provide an improved retarding device for retarding and positively separating a booster stage from the remainder of a missile or other vehicle.

According to the present invention, a booster retarding apparatus is provided which comprises a series of flaps, each flap having an associated mounting assembly for pivotally mounting it on the aft end of a booster so that the flaps fit together in a cylindrical skirt around the aft end of the booster, the mounting assembly allowing the flap to pivot between an inner position corresponding to part of the cylindrical skirt and an extended position projecting outwardly beyond the outer periphery of the booster, and including a biasing assembly for urging each flap outwardly into its extended position. A retaining or safing device is provided for normally retaining each flap in its inner position, the retaining device being arranged to be released automatically on booster thrust termination.

The retaining device in the preferred embodiment of the invention includes latch arms and a latch biasing assembly urging the arms apart to arm the apparatus. The latch biasing assembly has an effective biasing force less than the acceleration forces developed on launch of the vehicle which oppose the biasing assembly to hold the latch arms together until thrust termination. Once thrust is terminated, the biasing assembly separates the latch arms, so that the flaps are urged outwards to act as braking devices, and the booster stage is braked or retarded to stabilize and separate it from the remainder of the missile. The final stage can then be ignited.

The drag flaps are actuated or extended automatically on thrust termination, requiring no additional timers, electrical actuation, or explosive actuators. It is the physical effect of thrust termination or cessation of G force which allows the device to actuate, requiring no additional actuators. The flaps will extend immediately and automatically on thrust termination, providing fast and effective booster separation. The apparatus is simple, light weight and volume efficient. The flaps can be mounted in the unused volume around the booster rocket nozzle or nozzles, where they will not take up any additional space.

The retaining device includes a safing mechanism for normally maintaining the apparatus in its inoperative position. The safing mechanism may, for example, comprise wires holding the latch arms together and extending over the booster rocket nozzle, so that they will melt on firing of the motor, releasing the flaps. The wires will be designed not to melt until sufficient thrust has been developed to oppose the latch biasing assembly and hold the latching arms closed. Alternatively, one or more safing pins holding the latching arms closed could be arranged to be pulled on launch. Other safing arrangements are possible.

The missile and booster stages may be telescopically or frictionally force fitted or interconnected in any standard manner, for example via explosive bolts which are detonated at the appropriate time to release the missile from the booster. The booster will be automatically slowed down by the retarding apparatus and separated from the remainder of the missile, thus requiring no pyrotechnic or other devices at the booster/missile interface to produce positive separation. The retarding apparatus of this invention will provide a fast and efficient mechanical drag or braking means, taking up no internal volume in the vehicle and requiring no actuation device such as an electronic or pyrotechnic actuator which would take up potentially needed space within the missile body.

BRIEF DESCRIPTION OF THE DRAWINGS

The present invention will be better understood from the following detailed description of a preferred embodiment thereof, taken in conjunction with the accompanying drawings, in which like reference numerals refer to like parts, and in which.

DESCRIPTION OF THE PREFERRED EMBODIMENT

Figure 1:
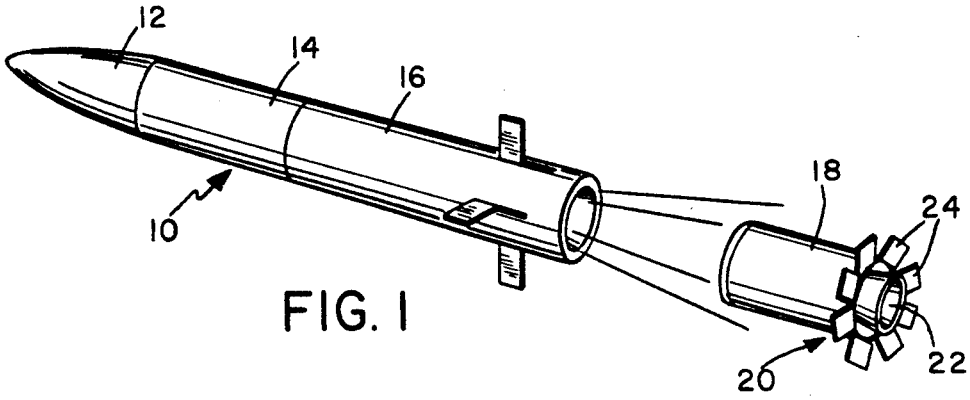
FIG. 1 illustrates a typical missile in flight with the booster section being retarded and separated by a retarding mechanism according to a preferred embodiment of the invention.

FIG. 1 of the drawings illustrates a missile 10 having a forward portion or nose cone 12, cylindrical central section 14, sustainer or main motor section 16, and a booster section 18 at the aft end of the sustainer motor 16. A retarding apparatus 20 according to a preferred embodiment of the present invention is attached to the aft end of booster 18, as described in more detail below and illustrated in FIGS. 2 and 3. In FIG. 1, the booster 18 is shown separated from the remainder of the missile, with the retarding mechanism 20 deployed.

The booster 18 is of a conventional type used to launch missiles or other multi-stage vehicles, and comprises a rocket motor having one or more nozzles 22 at its rear or aft end. The forward end of the booster is attached by any conventional releasable mechanism to the aft end of the rocket motor 16, for example via clamps or explosive bolts.

After launch of the missile 10, rapid separation of the booster is required to allow ignition of the final missile stage or main motor 16. The retarding mechanism 20 illustrated in FIGS. to 3 is arranged to retard the booster 18 at the desired instant when the booster is released, to separate it from the upper or final stage of the missile, as illustrated in FIG. 1.

The retarding mechanism 20 comprises a series of drag flaps or petals 24 each pivotally connected to the aft end of the booster 18 via hinge links 25. In the inoperative or undeployed position illustrated in FIG. 2, the flaps form a cylindrical array or skirt of diameter substantially equal to that of the booster 18 extending around the rocket nozzle or nozzles 22. Additionally, one or more biasing or torsion springs 26 are mounted on each flap, and secured at one end to the aft end or rear bulkhead 30 of the booster 18 and at the opposite end to an inner face of the respective flap 24. The respective spring links 26 urge each flap radially outwardly towards the extended or deployed position illustrated in FIGS. 1 and 3, in which each flap projects outwardly from the aft periphery of the booster 18 to act as a drag or braking member. One or more springs 26 may be provided on each flap to secure it to the bulkhead 30.

Figure 2:
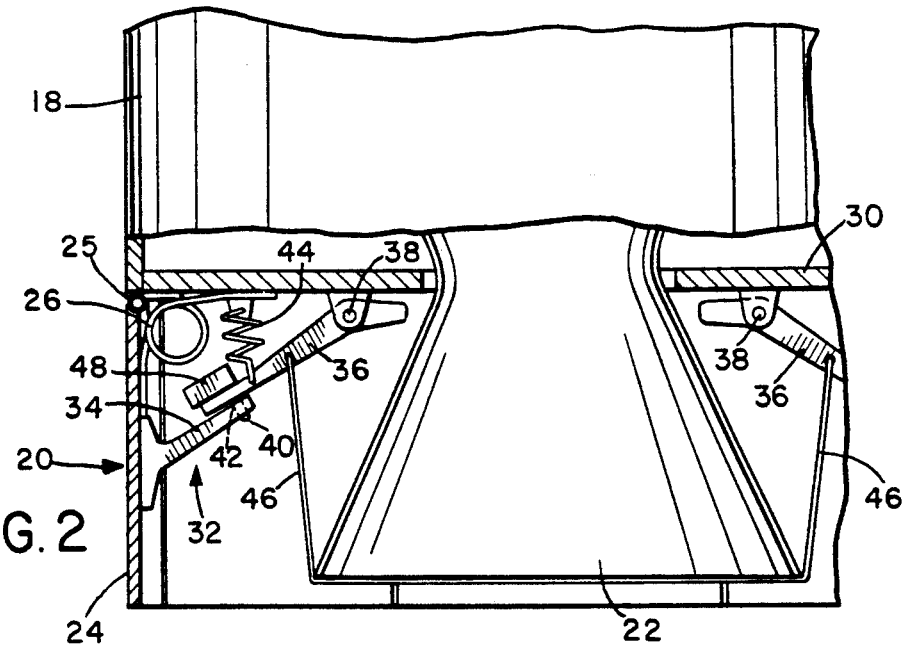
FIG. 2 is a side elevation view of the rear end portion of the booster, with portions cut away to show the retarding mechanism in the closed and safetied position.

Each flap is normally retained in its inoperative position via a retaining assembly including a releasable connecting latch or link 32 which secures the respective flap to the bulkhead 30 in the inoperative position illustrated in FIG. 2. The latch 32 comprises a first arm 34 secured to the respective flap 24 and a second, lever arm 36 pivotally secured to the bulkhead 30 via pivot 38. The first and second arms 34,36 are releasably latched together via latch pin 40 on arm 36 which projects transversely through an aligned opening 42 in the end of arm 34 when in the position illustrated in FIG. 2. A latch release spring 44 extends between the arm 36 and the bulkhead to urge the arm 36 upwardly into the position illustrated in FIG. 3, releasing the pin 40 from opening 42 to release the retarding or separating mechanism. The arm is normally maintained in the latched position illustrated in FIG. 2 by a suitable safety device or retainer designed to be released on launch of the missile to arm the device. In the preferred embodiment illustrated in FIG. 2, each actuator arm 36 is secured to the aft end of the rocket nozzle by a wire 46 which sources the arms in the latched position against the action of spring 44. Two of the retainer or safety wires 46 are illustrated in FIG. 2. Alternative safing mechanisms may be used in place of wires 46. For example, one or more safing pins holding the flaps closed could be arranged to be pulled on launch. One specific example of the latter alternative is described in more detail below in connection with FIGS. 4 and 5.

The wires 46 are of a suitable material designed to melt on firing of the boost motor, releasing the actuator arms 36. Inertia weights 48 are preferably added to the ends of each actuator arm 36 to ensure sufficient counter balance to the relatively stiff spring 44 which will be required to overcome friction at the latch between arms 34 and 36. The spring tension or force of spring 44 urging the arm 36 and weight 08 upwards as viewed in FIG. 2 is arranged to be less than the effective acceleration forces urging the arm and weight in the opposite direction during booster thrust. Thus, the latch arm 36 will remain in the position shown in FIG. 2 during booster thrust and the flaps will remain closed.

Figure 3:
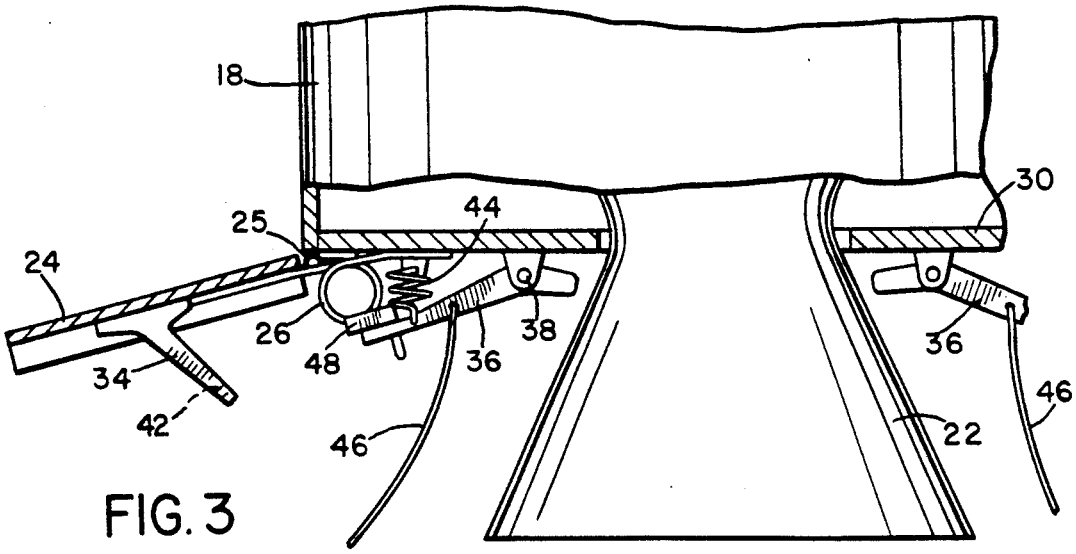
FIG. 3 is a similar view with the retarding mechanism released and the drag petals or flaps extended.

As the missile is launched and the retarding mechanism is armed by release of wires 36, outward movement of the flaps will be prevented by the developed acceleration or G-forces holding the latch closed. The biasing springs 44 are designed to have an effective biasing force which is less than the thrust of the boost motor acting on the arm 36 when the wires are released. Thus, the flaps will not be deployed until booster thrust terminates. Once booster thrust terminates, the latch springs 44 will urge arms 36 upwardly as illustrated in FIG. 3, and springs 26 urge all the flaps outwardly into the deployed position illustrated in FIGS. 1 and 3, retarding or braking the booster section so that it separates from the remainder of the missile. The joints or bolts connecting the forward end of the missile to the booster can be released in any known manner at or prior to booster thrust termination. For example, explosive bolts may be used. The main missile motor 16 can then be ignited.

The deployed drag flaps act as speedbrakes to both separate the booster from the remainder of the missile and to stabilize the booster as it separates. The safety wires are designed to burn through on booster firing, but are strong enough not to burn through until the missile has developed sufficient thrust to hold the latch closed against the action of spring 44, thus maintaining the flaps in their inoperative position during booster thrust.

The separating mechanism does not take up any extra space in the missile or booster body, but fits into unused volume surrounding the booster nozzle. Thus, the mechanism does not require any decreased motor volume in the missile or booster. The mechanism is actuated automatically on booster thrust termination, at the exact point when separation is required, and does not need any extra timers, electronics or pyrotechnic devices to actuate it. The mechanism is purely mechanical and operated by springs, and is thus not subject to any of the problems encountered by electronic or pyrotechnically actuated separation devices. The mechanism is lightweight and low volume, and can be used on slimline or other tactical missile boosters. It is armed automatically at missile launch and activates automatically when booster thrust is terminated. The mechanism relies solely on booster thrust termination and the ensuing cessation of acceleration forces to release the drag brakes, thus requiring no additional electronic or pyrotechnic actuators or timers.

Figure 4:
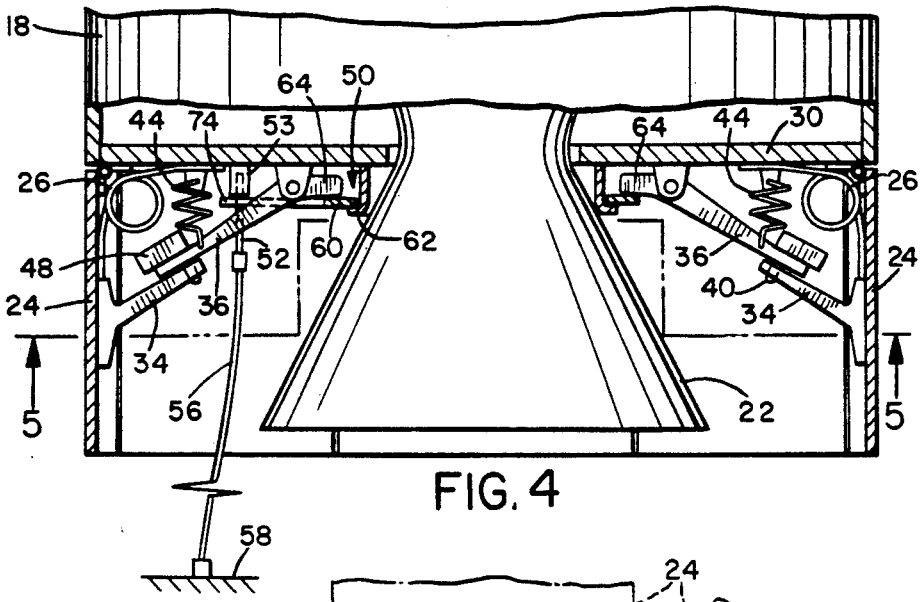
FIG. 4 is a view similar to FIG. 2, with an alternative safety and arming mechanism.

FIGS. 3 and 4 of the drawings illustrate an alternative safing or arming assembly 50 for releasing the latch arms 36. The safing assembly 50 of FIGS. 3 and 4 replaces the safety wires of FIG. 2. The mechanism is otherwise identical to that of FIGS. 2 and 3, and like reference numerals have been used where appropriate. The assembly 50 includes a safety or stop pin 52 releasably engaged in suitable receiving socket 53 provided on bulkhead 30, and a tether 56 connecting pin 52 to the launch structure 58. The pin 52 will therefore be pulled out as the missile moves away from the launch structure. The length of tether 56 controls the point at which the safety pin 52 is pulled out, and can be designed so that sufficient thrust has been developed at that point to hold the latch arms 36 down and the flaps closed.

A retaining ring 60 is rotatably mounted in an annular support flange 62 on bulkhead 30 to extend around the rocket nozzle, and is arranged to normally project under the short ends 64 of the respective lever arms 36 to oppose downward movement of ends 64, and thus oppose upward movement of the longer ends of arms 36 to release arms 34. The ring is urged between the solid-line, operative position and the dotted-line, release position illustrated in FIG. 5 by means of release spring 66. Spring 66 is secured between a projecting radial arm 68 of ring 60 and an appropriate position on the bulkhead to urge the ring in a clockwise direction. A suitable stop 70 limits rotation of ring 60 so that it is stopped in a position in which a series of notches 72 in the ring are aligned with the respective lever arms 36 to release the arms for pivotal movement away from arms 34.

The safing pin 52 normally extends through an opening 73 in a radial safing arm 74 on ring 60 to hold the ring in its operative position and thus prevent release of the flaps 24.

Figure 5:
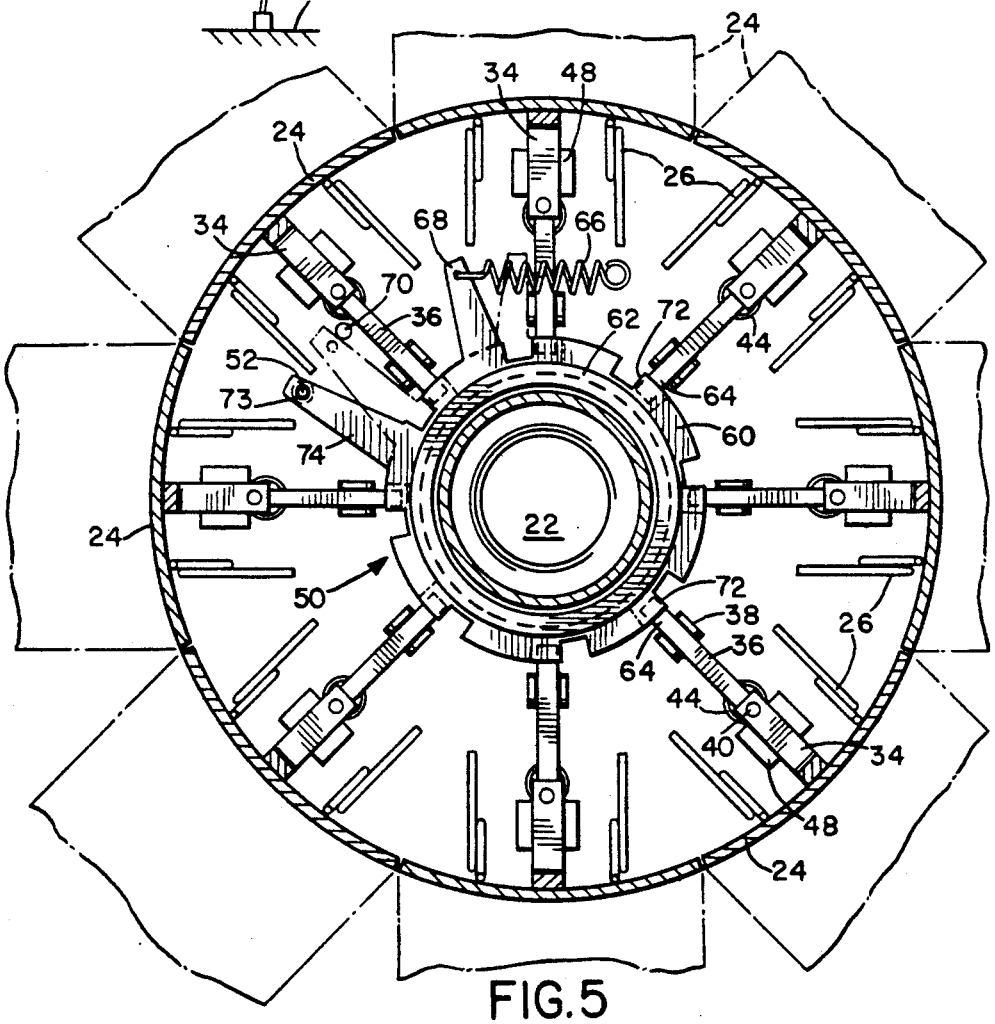
FIG. 5 is a section view taken on line 5—5 of FIG. 4.

With this arrangement, upon launch of the missile the tether 56 will pull the pin 52 out of safing arm 74, releasing retaining ring 60 and allowing spring 66 to pull the ring into the dotted line position of FIG. 5. This in turn allows the latch to be released by upward movement of the latch arm 36 under the action of spring 44. However, as the missile is already in motion when pin 52 is pulled, sufficient missile thrust should already have developed to oppose upward movement of latch arm 36 as viewed in FIG. 4. As in the previous embodiment, flaps 24 will move outwardly automatically on termination of booster thrust, since springs 44 will urge latch arms 36 away from arms 34 to release the flaps, braking the booster and separating it from the remainder of the missile prior to final stage ignition. Any suitable pin or retainer for pinning the short ends of the actuator arms may be utilized in place of retaining ring 60, with the safety or stop pin release allowing a spring to pull or retract the pins or retainers to arm the separating device.

Thus, the separation or retarding mechanism described above is designed to be safed and armed automatically on launch and to be activated automatically on booster thrust termination. Since it is designed to be mounted at the aft end of the booster in unused space around the rocket nozzle or nozzles, it is volume efficient and does not take up otherwise usable space within the missile or booster body. It is a simple, lightweight and effective mechanism providing automatic and stable booster separation at the desired time.

The mechanism is also compatible with a requirement for rocket nozzle thrust vectoring or jet tab thrust vectoring. Four of the flaps 24 in FIG. 5 at 90° intervals can be made to extend further around the circumference of the missile booster. The alternate flaps and four release mechanisms can then be replaced by thrust vectoring actuators, providing volume for these components while still providing symmetrical drag on thrust termination for booster separation.

Although some preferred embodiments of the invention have been described above by way of example only, it will be understood by those skilled in the field that modifications may be made to the disclosed embodiments without departing from the scope of the invention, which is defined by the appended claims.

I CLAIM:

1. Booster retarding apparatus for a missile having a front and a rear end and a separable booster releasably mounted at the rear end, the apparatus comprising:

a series of flaps;

securing means for pivotally securing each flap to an aft end of a missile booster for movement between an inner operative position in which the flaps extend rearwardly from the booster and an extended operative, booster retarding position in which the flaps project outwardly from an outer periphery of the booster, the securing means including biasing means for urging each flap outwardly into its extended position; and retaining means for normally retaining each flap n its inner position, the retaining means including release means responsive to booster thrust termination to release said retaining means so that the flaps are urged outwardly on booster thrust termination.

2. The apparatus as claimed in claim 1, wherein said flaps form a cylindrical skirt extending rearwardly from the aft end of the booster and surrounding a booster rocket nozzle or nozzles at said booster aft end in said inner position.

3. The apparatus as claimed in claim 2, wherein said skirt has a diameter substantially equal to that of said booster.

4. The apparatus as claimed in claim 1, wherein said retaining means comprises latch means for releasably securing each flap to the aft end of the booster, latch biasing means for urging said latch means in a direction to release said flaps, and safing means for normally opposing said latch biasing means to retain said latch means in an operative position, said safing means comprising means for releasing said latch means on launch of the missile, and said latch means including means responsive to the acceleration forces developed on launch of the missile to oppose said latch biasing means, said latch biasing means having an effective biasing force less than the acceleration forces developed on launch so that said latch means is released on booster thrust termination.

5. The apparatus as claimed in claim 1, wherein said securing means comprises a series of hinge means each having first and second opposite ends, each hinge means being secured at its first end to a respective one of the flaps, the opposite, second end of each hinge means comprising means for securing to the aft end of a booster.

6. The apparatus as claimed in claim 1, wherein said biasing means each comprise at least one torsion spring for biasing the respective attached flap outwardly into its extended position.

7. The apparatus as claimed in claim 1, wherein said retaining means includes a plurality of latch mechanisms, each latch mechanism comprising means for releasably securing a respective one of the flaps to the aft end of a booster in its inner position.

8. The apparatus as claimed in claim 7, wherein each latch mechanism comprises a first arm secured to the respective flap, a second arm latched to the first arm, and pivot means for releasably pivoting said second arm to the aft end of the booster for movement between a first position latched with the first arm and a second position released from the first arm.

9. The apparatus as claimed in claim 8, wherein said release means comprises latch biasing means urging each second arm towards said second position and safing means normally holding said second arm in said first position, said safing means comprising means for releasing said second arms on launch of said missile, and said latch biasing means having an effective biasing force less than the acceleration forces developed on launch in opposition to said biasing force.

10. The apparatus as claimed in claim 9, including an inertia weight on an end of said second arm for biasing it towards said first position.

11. The apparatus as claimed in claim 9, wherein said safing means comprise a series of wires for connecting each second arm to a rocket nozzle of said booster, said wires comprising means for burning through on firing of said booster to release said second arms.

12. The apparatus as claimed in claim 9, wherein said safing means comprises safing pin means for opposing movement of said second arms into said second position, and tether means for connecting said safing pin means to a stationary part of a missile launch structure to pull out said safing pin means on launch.

13. The apparatus as claimed in claim 1, wherein said retaining means comprises link means for releasably connecting each flap to the aft end of a booster in said inner position, said release means comprising separating means for separating said link means, and safing means for opposing operation of said separating means, said safing means including means for releasing said separating means on launch of said missile and means responsive to the acceleration forces developed on launch to oppose operation of said separating means until booster thrust termination.

14. A method of separating a booster from a missile on termination of booster thrust, comprising the steps of:

pivotally mounting a series of flaps around an aft end of the booster, the flaps being pivotable between an inner position in which they extend rearwardly from the end of the booster and an extended position in which they project outwardly beyond an outer periphery of the booster;

applying a biasing force to urge the flaps towards their extended positions;

retaining the flaps in their inner position until booster thrust termination;

releasing the flaps on booster thrust termination; and urging the flaps outwardly on thrust termination to retard the booster and separate it from the remainder of the missile.

15. A missile comprising a forward section, a sustainer motor secured to the forward section for propelling the missile, the sustainer motor having an aft end, a booster releasably secured to the aft end of the sustainer motor for launching the missile, the booster having an aft end and an outer periphery surrounding said aft end, and a booster retarding assembly secured to the aft end of the booster for retarding the booster on booster thrust termination to separate it from the aft end of the sustainer motor, the booster having at least one exhaust nozzle, the retarding assembly comprising a series of drag flaps, hinge means securing said flaps to the aft end of said booster for movement between an inner position in which the flaps extend rewardly from the booster and an extended position in which the flaps project outwardly beyond the outer periphery of the booster;

biasing means for urging each flap outwardly into its extended position; and retaining means for normally retaining each flap in its inner position, including release means responsive to booster thrust termination to release said retaining means.

16. The missile as claimed in claim 15, wherein said drag flaps form a cylindrical skirt surrounding the exhaust nozzle in said inner position.

* * * * *